United States Patent [19]

Lewis

[11] Patent Number: 4,880,240

[45] Date of Patent: Nov. 14, 1989

[54] PUTTING PRACTICE DEVICE

[76] Inventor: John F. Lewis, P.O. Box 363, Quebec, Canada, J0P 1J0

[21] Appl. No.: 247,766

[22] Filed: Sep. 22, 1988

[30] Foreign Application Priority Data

Sep. 25, 1987 [CA] Canada ..... 547815

[51] Int. Cl.[4] ..... A63B 69/36

[52] U.S. Cl. ..... 273/188 R; 273/192; 273/81 B; 273/183 B

[58] Field of Search ..... 273/162 R, 81 B, 81 D, 273/81 C, 165, 166, 81.4, 81.5, 81.6, 183 B, 81 R, 191, 191 A, 191 B, 192, 188 R, 189 R

[56] References Cited

U.S. PATENT DOCUMENTS

| | | | |
|---|---|---|---|
| 1,561,349 | 11/1925 | Murphy et al. | 273/81.3 |
| 1,616,377 | 2/1927 | Knight | 273/81.3 |
| 1,618,638 | 2/1927 | Coles | 273/77 R |
| 1,684,192 | 9/1928 | Nemeth | 273/188 R |
| 2,132,219 | 10/1938 | Pirie | 273/81.3 |
| 2,706,635 | 4/1955 | Thomas | 273/192 |
| 3,170,690 | 2/1965 | Goranson et al. | 273/81.3 |
| 3,188,086 | 6/1965 | Parmley | 273/81.3 |
| 4,491,323 | 1/1985 | Kozub | 273/81.4 |

FOREIGN PATENT DOCUMENTS

| | | | |
|---|---|---|---|
| 522814 | 6/1940 | United Kingdom | 273/191 R |

*Primary Examiner*—George J. Marlo
*Attorney, Agent, or Firm*—Price, Heneveld, Cooper, DeWitt & Litton

[57] ABSTRACT

An apparatus designed to increase the consistency of a golfer's putting stroke by providing a specially constructed putter and a putting stroke guide worn at the user's waist. The golf putter has a putter head, a putter shaft, and a grip; the grip being provided with a flat, straight face extending along its length and wider at the remote end of the grip, the face being aligned so that it is at right angles to the face of the putter head and is on the same side of the grip as the rear end of the putter head. The guide is attachable to a golfer's belt or a waist band and provides a flat surface cooperable with the flat face on the putter grip to direct the putting stroke.

19 Claims, 3 Drawing Sheets

PUTTING PRACTICE DEVICE

This invention relates to an apparatus for assisting golfers in improving their putting stroke and more particularly to a novel putter having a flat face on the rear of the grip so that the head of the putter can be aligned by holding the upper part of the grip against a flat straight guide at the region of the golfer's waist.

BACKGROUND OF THE INVENTION

One of the most unreliable aspects of the game of golf is being able to consistently play the ball in its intended direction when putting. Mistakes in the swing of the putter head cause the ball to be "pulled" or "pushed", which deviates the travel of the ball from the intended putting direction.

Various methods have been utilized to obtain a more reliable putting stroke, as shown in the following U.S. Pat. Nos.:

1,561,349, issued November 10, 1925 to C. B. Murphy et al;

1,616,377, issued February 1, 1927 to B. Knight;

2,132,219, issued October 4, 1938 to J. Pirie;

3,170,690, issued February 23, 1965 to C. D. Goranson et al; and 3,188,086, issued June 8, 1965 to R. T. Parmley.

Each of the above listed patents show putters which can be swung about a specific point that is either a pivot at the top end of the grip of a putter or a pivot within the grip of a putter.

None of these patents, however, disclose a putter which is acceptable in the "Rules of Golf" as approved by the The Royal and Ancient Golf Club of St. Andrews, Scotland and The Royal Canadian Golf Association and United States Golf Association. The putters disclosed in these patents are, therefore, acceptable for practice or for "friendly" games but cannot be used in tournaments or official games. It should also be noted that the putters described in the above patents do not provide as much putting control as most golfers would prefer.

It is also known that there are golfers who need assistance in order to be able to putt correctly. For instance, there are blind or partially blind golfers who have difficulty in putting in the correct direction after being advised or guided to the position of a ball and the required stroke for the sinking of the ball. There are also golfers who cannot putt smoothly and accurately because of health problems such as nervous disorders. These people find it difficult to hold the putter or swing it smoothly without shaking.

It would be a great advantage to golfers if a putter were available which could be repeatedly guided with relative accuracy in a smooth swing. Furthermore, the usefulness of such a golf putter would be maximized if it were acceptable under the 'Rules of Golf'.

BRIEF SUMMARY OF THE INVENTION

It is an object of the invention to provide a golf putter acceptable under the Rules of Golf which can assist a golfer in perfecting his or her putting stroke.

All of the embodiments of the golf putter of this invention, except one, conform to the requirements for putters which are acceptable under the "Rules of Golf". Each of the embodiments disclosed hereinafter promote a much improved putting stroke.

The golf putter has of a conventional shaft and putter head which is secured in an acceptable and normal manner to an elongated putter grip. The grip is formed with an elongated flat face on one side, the upper end of the grip preferably being somewhat wider than normal. The flat face on the grip is positioned above the rear end of the putter head and aligned at right angles to the face of the putter head.

The putter is preferably used with a straight, rigid elongated guide plate which is attached to a belt and positioned at the front of the waist so that, during putting, the flat face of the grip rests against the straight edges guide. The stroke of the putter will be along a predetermined arc as long as the flat face of the grip is held against the straight edge on the belt. Orientation and stabilization of the putter grip on the guide may be improved by having either the flat face of the grip or the guide, or both the flat face of the grip and the guide constructed of a magnetic or a magnetized metal.

BRIEF DESCRIPTION OF THE DRAWINGS

The invention will now be described by way of example only and with reference to the accompanying drawings wherein.

DETAILED DESCRIPTION OF THE PREFERRED EMBODIMENTS

Figure 1:
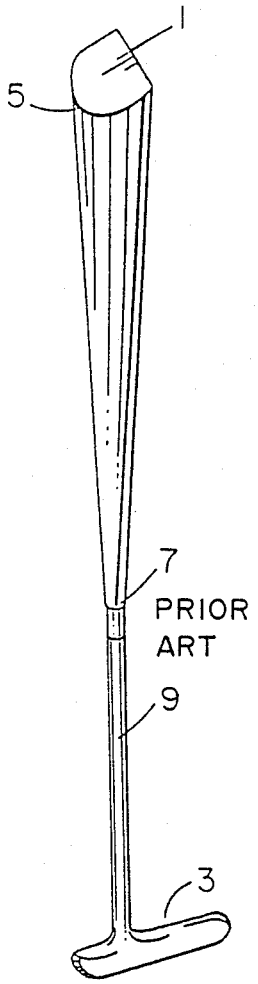
FIG. 1 is a perspective view of a putter showing a known type of grip which is already approved and appears in the types of approved grips in the Royal Canadian Golf Association and United States Golf Association "Rules of Golf", both of which are effective as of January 1, 1984.

As shown in FIG. 1, one of the approved putters in the 'Rules of Golf' has a grip having a flat face and a rounded back. The flat face is formed at a right angle to the face 3 of the putter head and is oriented toward the front end of the putter head. The grip is wider at the top end 5 than at the bottom end 7 and is attached to the putter shaft 9 in a manner well known in the art.

Figure 2:
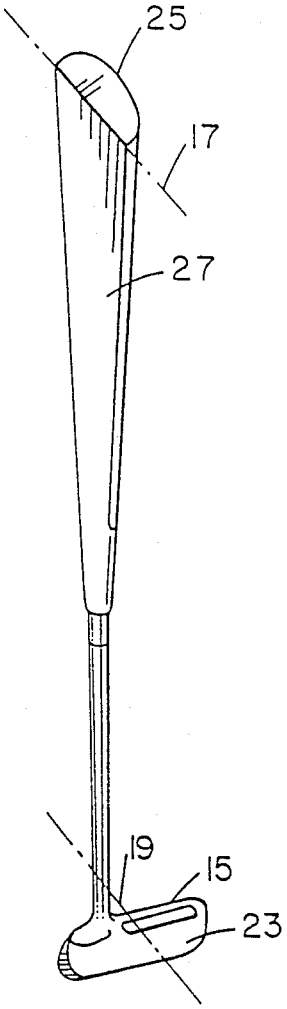
FIG. 2 is a perspective view of a putter according to the invention.

In FIG. 2 there is shown an embodiment of a golf putter in accordance with the invention having a grip 11 which is similar in shape to the grip shown in FIG. 1, except that the flat face 27 faces the rear end of the putter head. The broken line 17 is on the plane of ace 27 and the broken line 19 is at right angles to the face 15. Lines 17 and 19 must be parallel if the putter is to function properly. The length of the grip is such that its upper end 25 will normally be slightly higher than the waist of the user when in a putting position.

Figure 3:
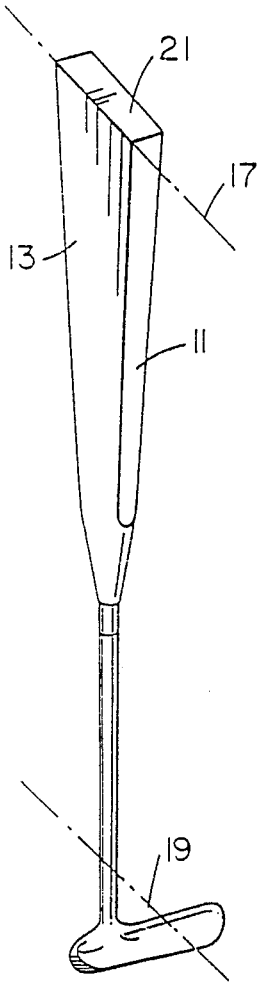
FIG. 3 shows a further embodiment of putter according to the invention.

The putter shown in FIG. 3 is a variation of the embodiment shown in FIG. 2. The grip of this putter is rectangular in cross section, having a narrow face 11 and a wide face 13. The wide face 13 is positioned over the rear of the putter head and at right angles to the putter face.

The flat faces 13 and 27 of the putter grips are preferably finished with an anti-friction surface so that they will slide over a golfer's clothing without sticking.

Figure 6:
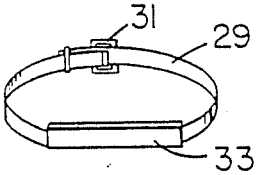
FIG. 6 is a perspective view of a belt including a guide plate for use with the putter of the invention.

FIG. 6 illustrates the guide which is preferably used in conjunction with the golf putter shown in FIGS. 2 or 3. The guide includes a leather or plastic belt 29 provided with a buckle 31 and a straight, elongated, rigid guide plate 33 preferably formed from metal or rigid plastic and secured to the belt by welding, gluing or the like. The guide plate 33 is preferably 3 to 8 inches long but may be any suitable length. Magnetized metals may be used in the construction of either the plate or the guide, or both, assisting the golfer in maintaining the flat side of the grip of the putter in contact with the guide. This has proven to facilitate the contact of the full breadth of the flat side of the grip with the guide during the duration of the putting stroke while permitting the flat side of the grip (and therefore the face of the putter) to move in the intended direction.

Figure 4:
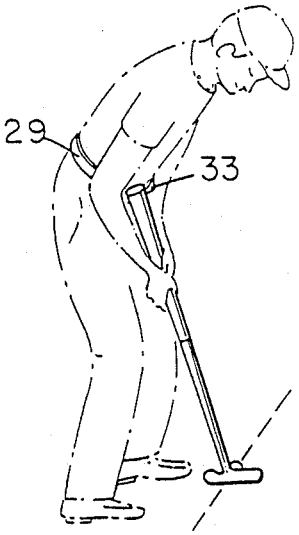
FIG. 4 shows a golfer using the putter of the invention.
Figure 5:
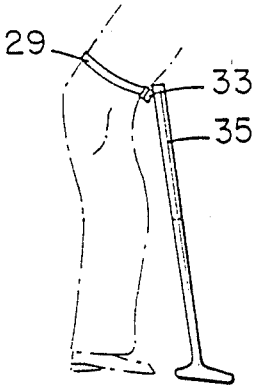
FIG. 5 shows in clearer detail, the putter of the invention in use.

A golf putter in accordance with the invention is shown in use in FIGS. 4 and 5. In both cases a belt 29 is being worn with the guide plate 33 positioned at the front of the wearer. The putter is held so that the full breadth of face 13, 27 is against the guide plate 33. A golfer aligns the face of the putter with the ball and the hole by moving to the proper position. Once aligned, the golfer can stroke with great accuracy as long as the face 13, 27 is held in contact with the guide plate 33. Note that the normal length of a golf putter is indicated by line 35 in FIG. 5 and, therefore, the hands of the golfer will be between the line 35 and the lower end of the grip. Thus, normal arm and wrist action in putting can be accommodated even while the face 13, 27 of the grip is being urged lightly against the guide plate 33.

Figure 7:
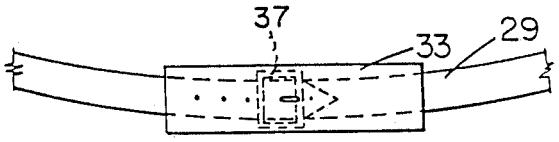
FIG. 7 is a perspective view of part of a belt incorporating a guide plate as part of the buckle.

In FIG. 7 there is shown a belt in which the buckle is integral with the guide plate 33, the guide plate having a buckle mechanism 37 secured to the rear side of the guide plate.

Figure 8A:
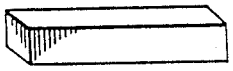
FIGS. 8*a*–8*j* show various shapes of guide plates.
Figure 8B:
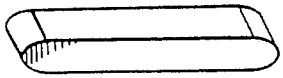
Figure 8C:
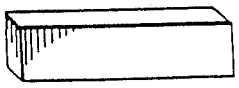
Figure 8D:
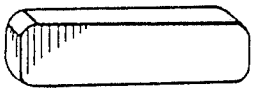
Figure 8E:
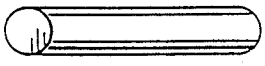
Figure 8F:
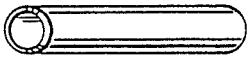
Figure 8G:
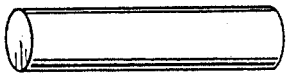
Figure 8H:
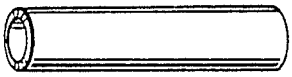
Figure 8I:
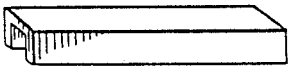
Figure 8J:
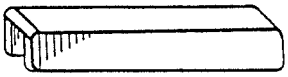

Various shapes are suitable for guide plates as shown in FIGS. 8*a*–8*j*. These plates may be secured to a belt buckle by welding, gluing or the like, or, alternatively, made integral with the buckle. The shapes illustrated in FIGS. 8*i* and 8*j*, provide channel shaped guides which can be sized to accommodate the upper end of the putter of FIG. 3 so that a positive guide is formed.

Figure 9:
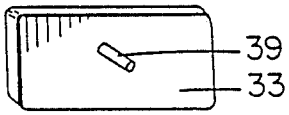
FIG. 9 is a perspective view of a further type of guide plate.
Figure 10:
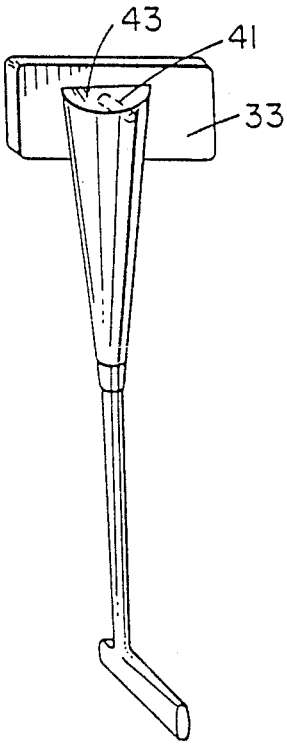
FIG. 10 is a perspective view of a putter in cooperation with the guide plate of FIG. 9.

In FIG. 9, a guide plate 33 is shown with a pin 39 protruding from the front surface, and FIG. 10 illustrates a putter having a hole 41 formed in the flat face of the grip to accommodate the pin 39. The putter is thus pivotable about the pin 39 to achieve greater putting accuracy.

It will thus be apparent that a novel apparatus has been disclosed which provides accurate, repeatable putting movement and, with the exception of the putter shown in FIG. 10, does so while staying within the requirements of the 'Rules of Golf'. The putter can therefore be used in tournaments and in fact can be used as a replacement for the traditional style of putter.

Furthermore, depending upon the anatomy of a golfer, certain golfers may find it possible to use the golf putter disclosed without having to utilize a guide plate 33 (see FIG. 7).

It is also possible to produce a flat sided extension for a golf putter grip with a means for releasably securing it to the upper end of a normal golf putter. Such an extension may not meet the requirements of the "Rules of Golf"; however, it would enable a golfer to perfect a putting stroke with a putter which could later be used, without the extension, to play a round of golf.

The apparatus of this invention can therefore be used for practising the putting stroke best suited to a golfers particular anatomy and to a type of putting surface and/or terrain.

Each of the putters disclosed can be employed for various putting stroke styles such as, for example:

(1) Wrist action or mostly wrist action.
(2) Arm action or mostly arm action.
(3) Combination wrist and arm action.
(4) Rolling action to induce rolling of the ball.
(5) Short back stroke and long follow through.
(6) Pendulum action by using the top of the shaft as a fulcrum against the abdomen.

The embodiment shown in FIG. 10, when used with the guide pin as shown in FIG. 9, is best suited for practicing item 6 listed above.

Changes and modifications in the specifically described embodiments can be carried out without departing from the scope of the invention which is intended to be limited only by the scope of the appended claims.

The Embodiments of the Invention in which an exclusive property or privilege is claimed are defiend as follows:

1. Apparatus for assisting a golfer while putting, said apparatus comprising in combination:

a golf putter having a grip with a flat surface above the rear end of the putter head, said flat surface being aligned at right angles to the face of said putter head; and a guide means including means for attaching same to the waist of said golfer, said guide means providing a guiding surface cooperable with the flat surface of said putter grip for directing the putting stroke in a predetermined plane.

2. The combination of claim 1 comprising:

a putter head having a face and a rear end;

a putter shaft; and a grip spaced along said putter shaft from said putter head and having a flat surfaced region aligned so that it is above said rear end of and at right angles to said face of said putter head.

3. The combination of claim 2 wherein said flat surfaced region extends longitudinally the full length of said grip.

4. The combination of claim 2 wherein said flat surfaced region comprises a thin flat plate which can be removably secured to said golf putter grip.

5. The combination of claim 2, wherein said guide means comprises a smooth linear guiding surface cooperable with said flat surfaced region on said putter grip for directing the putting stroke.

6. The apparatus as in claim 5 wherein said guide means comprises a flat plate.

7. The apparatus as in claim 6 wherein said guide means is magnetic.

8. The apparatus as in claim 6 wherein said guide means is magnetized.

9. The apparatus as in claim 6 further provided with a pin projecting from the front surface of said flat plate, said pin being cooperable with a hole in at least one of the rear surface of said putter grip and an attachment to the rear surface of said putter grip attached thereto, so that said pin is parallel with said face of said putter when engaged in said hole, to direct the putting stroke.

10. The apparatus as in claim 9 wherein said guide means is magnetic.

11. The apparatus as in claim 9 wherein said guide means is magnetized.

12. The apparatus as in claim 5 wherein said guide means is tube shaped.

13. The apparatus as in claim 12 wherein said guide means is magnetic.

14. The apparatus as in claim 12 wherein said guide means is magnetized.

15. The apparatus as in claim 5 wherein said guide means is magnetic.

16. The apparatus as in claim 5 wherein said guide means is magnetized.

17. The combination of claim 1 including an attachment to provide said flat surface of said putter grip; said putter head including a ball striking force and a rear end; said attachment including a flat thin plate which is removably secured to said golf putter grip so that said plate is above said rear end of and at right angles to said face of said putter head to provide a guiding surface for directing the putting stroke.

18. The combination of claim 17 wherein said attachment is magnetic.

19. The combination of claim 17 wherein said attachment is magnetized.

* * * * *

UNITED STATES PATENT AND TRADEMARK OFFICE

CERTIFICATE OF CORRECTION

PATENT NO. : 4,880,240

DATED : November 14, 1989

INVENTOR(S) : John F. Lewis

It is certified that error appears in the above-identified patent and that said Letters Patent is hereby corrected as shown below:

Column 2, line 11:

"edges" should be --edged--.

Column 2, line 59:

"ace" should be --face--.

Column 6, claim 17, line 5:

"force" should be --face--.

Signed and Sealed this

Fourteenth Day of May, 1991

*Attest:*

*Attesting Officer*

HARRY F. MANBECK, JR.

*Commissioner of Patents and Trademarks*